US005327872A

United States Patent [19]

Morikawa

[11] Patent Number: 5,327,872

[45] Date of Patent: Jul. 12, 1994

[54] FUEL PRESSURE CONTROL METHOD FOR HIGH PRESSURE DIRECT FUEL INJECTION ENGINE

[75] Inventor: Koji Morikawa, Muashino, Japan

[73] Assignee: Fuji Jukogyo Kabushiki Kaisha, Tokyo, Japan

[21] Appl. No.: 127,606

[22] Filed: Sep. 28, 1993

[30] Foreign Application Priority Data

Oct. 15, 1992 [JP] Japan ..... 4-277502

[51] Int. Cl.[5] ..... F02M 37/04

[52] U.S. Cl. ..... 123/516; 123/514; 123/179.17

[58] Field of Search ..... 123/516, 514, 452, 453, 123/454, 455, 456, 458, 179.17

[56] References Cited

U.S. PATENT DOCUMENTS

| | | | |
|---|---|---|---|
| 3,974,809 | 8/1976 | Stumpp | 123/452 |
| 4,346,687 | 8/1982 | Bauder | 123/516 |
| 4,370,967 | 2/1983 | Gmelin | 123/516 |
| 4,530,329 | 7/1985 | Maisch | 123/516 |
| 4,562,816 | 1/1986 | Dörr | 123/456 |
| 4,732,131 | 3/1988 | Hensel | 123/516 |
| 4,984,554 | 1/1991 | Ariga | 123/516 |
| 5,074,272 | 12/1991 | Bostick | 123/516 |

FOREIGN PATENT DOCUMENTS

| | | | |
|---|---|---|---|
| 53-41630 | 4/1978 | Japan | 123/516 |
| 58-48768 | 3/1983 | Japan | 123/516 |
| 0200663 | 12/1992 | Japan | 123/516 |

*Primary Examiner*—Carl S. Miller

*Attorney, Agent, or Firm*—Beveridge, DeGrandi, Weilacher & Young

[57] ABSTRACT

The fuel pressure is kept high for a specified time or until an engine temperature goes down below a specified value after an engine stop under a hot condition of engine in order to prevent vapor lock in the fuel system. Also, a starter motor is prohibited from being switched on until a fuel pressure reaches a specified value in order to prevent a high pressure fuel pump from being operated, whereby preventing sticking or scuffing in the high pressure fuel pump.

6 Claims, 10 Drawing Sheets

25
23
24
20
18
6
41
28
37
38
23c
19
9
3b
3c
7
2
17
1a
21
22
23b
31
8
1
5
3
3a
4
33
40
32
66
30
29
P
13
15
14
16
12
10
23a
11

FUEL PRESSURE CONTROL METHOD FOR HIGH PRESSURE DIRECT FUEL INJECTION ENGINE

BACKGROUND OF THE INVENTION

The present invention relates to a method for controlling a fuel pressure and more particularly to a method for holding a fuel pressure in high in a high pressure type direct fuel injection engine immediately after an engine stop.

Commonly, in a conventional high pressure type direct fuel injection engine ("high pressure type direct fuel injection engine" discussed herein is a fuel injection engine having a fuel injector for injecting fuel directly into a cylinder of an engine with a high pressure), the fuel pressure is released throughout the fuel system by letting a high pressure fuel regulator open upon an engine stop. This is in order to avoid problems caused in the fuel system, such as a fuel leakage from a fuel injector, deteriorations in relevant components and the like under a lasting high pressure being subjected to the fuel system.

However, when the fuel pressure is released at an engine stop, a vapor lock tends to occur in the fuel system due to a sudden pressure down of the heated fuel at portions where radiant heat is subjected from a heated engine and as a result, when an engine is tried to be restarted next after a short time, failed fuel injection is caused. Additionally, there occurs scuffing or sticking in bearing portions of a fuel pump due to insufficient lubrication.

To solve these problems, for example, Japanese patent application laid open No. 1985-116851 discloses a technology to eliminate a vapor lock at a restarting of engine in a hot condition by raising the fuel pressure in the fuel system so as to heighten a boiling point of fuel.

However, in an engine employing this prior art there is a problem of manipulation that a restarting of engine in a hot condition can not be made until the fuel pressure in the fuel system reaches a predetermined value. Hereinafter, "hot condition" of engine is referred to as a temperature condition under which vapor lock is caused in a fuel system of an engine.

SUMMARY OF THE INVENTION

In view of the foregoing, it is a primary object of the present invention to provide a method for controlling the fuel pressure of a high pressure type direct fuel injection engine so as to be able to make a quick and smooth restarting of an engine without causing a vapor lock even while the engine is in a hot condition. According to the present invention, in a high pressure type direct fuel injection engine, there is provided a method for controlling the fuel pressure in the fuel system more particularly holding the fuel pressure in high at least between a high pressure pump and a fuel injector for a specified elapsed time after an engine stop.

Additionally, it is a further object of the present invention to provide a method for controlling a starter motor to start an engine so as to prevent a fuel pump from being subjected to scuffing and sticking due to insufficient lubrication. According to the present invention, there is provided a method for prohibiting an operation of the starter motor until the fuel feed pressure reaches a specified value so as not to operate the fuel pump.

The method comprises the steps of, determining an engine temperature (coolant temperature) indicating a lower limit where a vapor lock maybe occurs, based on fuel volatility data and the like (hereinafter said engine temperature is referred to as "vapor lock temperature"), comparing an actual coolant temperature with said vapor lock temperature, holding the fuel pressure in high by continuing to operate an electronic control unit (ECU) of an engine for a specified time after an engine stop, comparing a fuel feed pressure with a predetermined fuel feed pressure and prohibiting an operation of the starter motor until said fuel feed pressure reaches said predetermined fuel feed pressure.

BRIEF DESCRIPTION OF DRAWINGS

FIG. 1 to FIG. 3 are flowcharts illustrating a fuel pressure control routine.

FIG. 4 is a flowchart showing a starter motor control routine.

FIG. 5 is a flowchart showing an ON-OFF interruption routine of a starter switch.

FIG. 6 is a flowchart illustrating a fuel injection control routine.

FIG. 7 is a schematic view of a control system of an engine.

FIG. 8 is a diagrammatic view of a control system of an engine.

FIG. 9 is a schematic view of a control system of an engine.

FIG. 10 is a diagrammatic view of a control system of an engine.

FIG. 11 is a flowchart illustrating a fuel pressure control routine corresponding to FIG. 1.

DETAILED DESCRIPTION OF PREFERRED EMBODIMENTS

Figure 7:
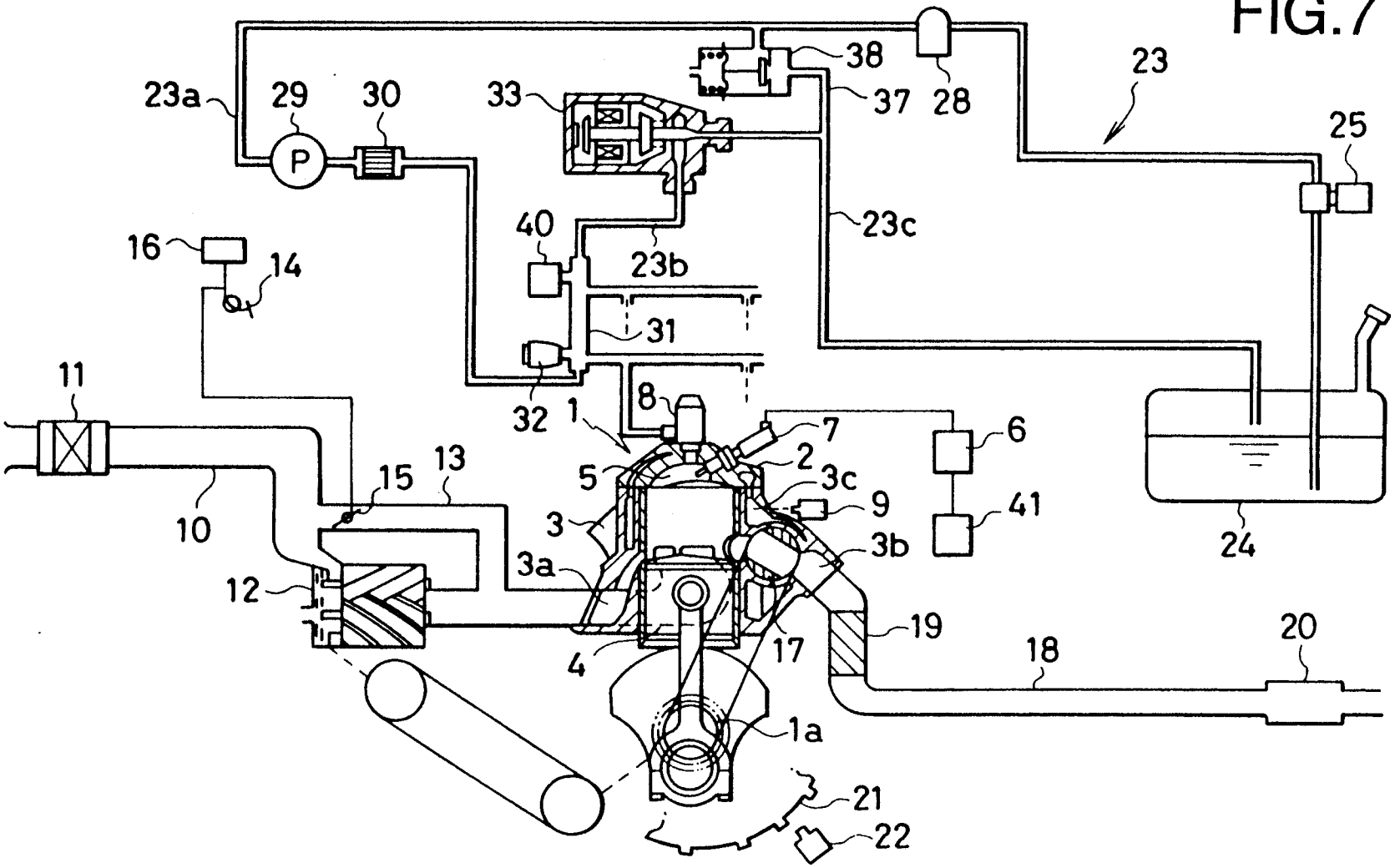

Referring to FIG. 7, reference numeral 1 denotes a high pressure type fuel injection two cycle engine. A cylinder head 2, a cylinder block 3 and a piston 4 form a combustion chamber 5 wherein a spark plug 7 and a fuel injector 8 are disposed. The spark plug 7 is connected to the secondary side of an ignition coil 6. Further, a scavenging port 3*a* and an exhaust port 3*b* are provided in the cylinder block 3 and in a coolant passage 3*c* of the cylinder block 3 a coolant temperature sensor 9 is disposed. The coolant temperature sensor 9 is a sensor to detect an engine temperature, accordingly any other alternative sensors to detect an engine temperature, such as an oil temperature sensor, a fuel temperature sensor and an engine room temperature sensor (a temperature sensor to detect air temperature inside of an engine room) may be used, although those are not shown.

Further, an air delivery pipe 10 is connected to the above scavenging port 3*a*. Upstream of the air delivery pipe 10 there is provided an air cleaner 11 and downstream thereof there is provided a scavenging pump 12 which is driven by a crank shaft 1*a*. The scavenging pump 12 supplies the fresh air to the engine and at the same time scavenges the combustion chamber 5 forcibly.

In a by-pass passage 13 by-passing the above scavenging pump 12 a by-pass control valve 15 operatively linked with an accelerator pedal 14 is provided. Also an accelerator pedal opening sensor 16 is coupled with the accelerator pedal. In the abovementioned exhaust port 3b, an exhaust rotary valve 17 mechanically interlocked with the crankshaft 1a is disposed. An exhaust pipe 18 is coupled with the exhaust port 3b through the rotary valve 17. In the exhaust pipe 18, a catalytic converter 19 and a muffler 20 are mounted in this order from upstream to downstream.

Further, a crank rotor 21 is coaxially coupled with the crank shaft 1a mounted on the cylinder block 3 and on the outer periphery of the crank rotor 21 a crank sensor 22 comprising an electromagnetic pick up and the like is provided. Reference numeral 23 indicates a fuel system which comprises a fuel feed pump 25 for feeding fuel from a fuel tank 24, a low pressure fuel system 23a for supplying fuel to a high pressure fuel pump 29 through a fuel filter 28, a high pressure fuel filter 30, a fuel supply passage 31 connecting with a fuel injector 8 of each cylinder, an electromagnetic type high pressure fuel regulator 33 and a fuel return system 23c for returning residual fuel to the fuel tank 24.

Further, in the low pressure fuel system 23a, a low pressure fuel regulator 38 for controlling the feed pressure to the high pressure fuel pump 29 is disposed and a fuel by-pass passage 37 is connected with the fuel regulator 38. Also an accumulator 32 for absorbing pressure pulses and a fuel pressure sensor 40 for detecting the fuel pressure are provided in the above fuel supply passage 31. In this embodiment, the electromagnetic type high pressure regulator 33 is a normally open type (normally open with current-off) which decreases its opening degree with an increase of a duty current and closes the valve with ON DUTY=100%.

Figure 8:
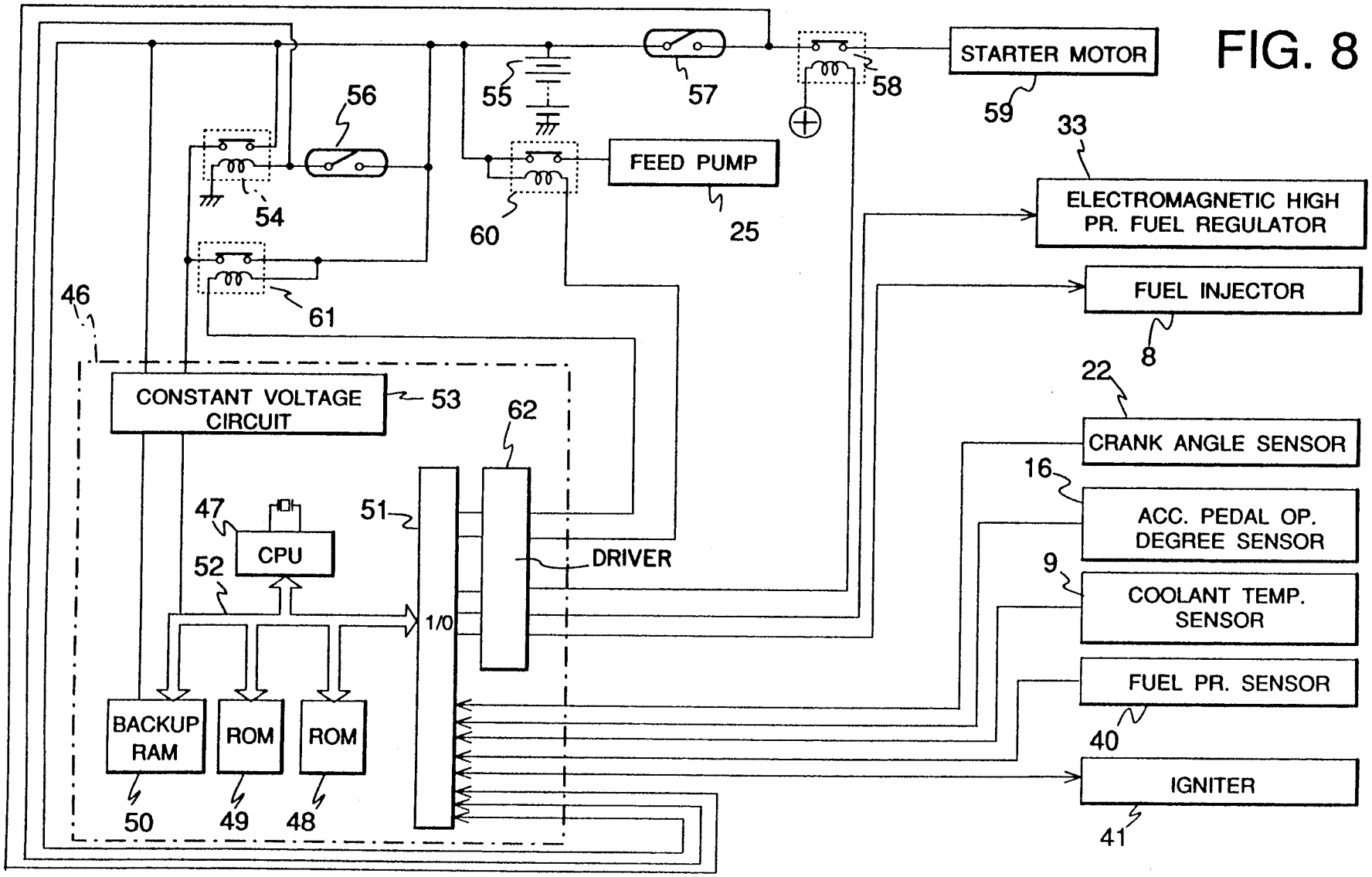

Referring now to FIG. 8, reference numeral 46 is an electronic control unit (ECU) which comprises a CPU 47, a ROM 48, a RAM 49, a backup RAM 50 and an I/O interface 51 connecting each other through a busline 52. Further, a constant voltage circuit 53 is incorporated in the above ECU 46. The constant voltage circuit 53 is connected to a battery 55 via a relay contact of an ECU relay 54. A relay coil of the ECU relay 54 is also connected with the above battery 55 via an ignition key switch 56. When the ignition key switch 56 is turned on, the contact of the ECU relay 54 is in an ON condition, whereby the battery voltage is supplied to the constant voltage circuit 53 and thus a stabilized voltage is furnished to components of the ECU 46 from the constant voltage circuit 53. Further, a relay contact of a self-shut relay 61 has a parallel connection with the ECU relay 54 and the ignition key switch 56. Further, a backup voltage is normally applied to the backup RAM 50 from the above constant voltage circuit 53. Also a starter switch 57 is communicated with the battery 55 and with a starter motor 59 via a starter motor relay 58. Further a feed pump 25 is communicated with the battery 55 via a relay contact of a feed pump relay 60. The battery 55 is connected with an input port of the above I/O interface 51 to monitor the battery voltage and further connected with the ignition key switch 56, the starter switch 57, the crank angle sensor 22, the accelerator pedal opening degree sensor 16, the coolant temperature sensor 9 and the fuel pressure sensor 40.

On the other hand, an igniter 41 for driving an ignition coil 6 is communicated with an output port of the I/O interface 51. The output port of the I/O interface 51 is also connected to a starter motor relay 58, a feed pump relay 60, each relay coil of a self-shut relay 61, a fuel injector 8 and a high pressure fuel regulator 33 respectively through a drive circuit 62.

Next, an operation of the ECU 46 will be explained according to flowcharts in FIG. 1 to FIG. 6.

First, when the ignition key switch 56 is turned on and the ECU 46 is in an ON condition, the system is initialized (flags, a count value and an output of I/O port cleared). Flowcharts in FIG. 1 to FIG. 3 indicate a fuel pressure control routine which is carried out at a specified interval while electrical power is applied to the ECU 46. At first, at a step 101 (hereinafter referred to as just "S something") it is judged whether an ignition key switch 56 is turned on or off. In case where it is judged at S101 that the ignition key switch 56 is turned on, the process goes to S102 where a count value C for counting an elapsed time after an engine stop is cleared. Next, it is judged whether at S103, S104 and S105, a normal control flag F3, a feed pressure flag F2 and an initialization flag F3 respectively have been set or not. As a matter of course, at an initial execution these flags F1, F2 and F3 have been already cleared and the process goes to S106 where a starter motor prohibition flag $F_{ST}$ is set ($F_{ST}=1$). This starter motor prohibition flag $F_{ST}$ is referred to at a starter motor control routine described hereinafter. In referring to the flag if $F_{ST}$ is equal to 1, current to the starter motor 59 is turned off even with a starter switch turned on.

Then the process goes to S107 where $G_1$, an I/O port output value to a relay coil of the feed pump relay 60 is set to 1. When $G_1$ is set, the feed pump relay 60 is turned on and the feed pump 25 is started. At S108 an initialization flag F1 is set and the process goes to S109 where a control signal to the electromagnetic type high pressure fuel regulator 33 "ON DUTY" is set to FFH (means 100%). At the next S110 this control signal ON DUTY is set as an I/O port output value to the high pressure fuel regulator 33. At S111 an I/O port output value $G_S$ to a relay coil of the self-shut relay 61 is set to 1, i.e., the self-shut relay 61 is turned on and then the process returns to the main routine. As a result of this, the feed pump 25 is started and the high pressure fuel regulator 33 is closed to prepare pressure rise for both low and high pressure fuel systems.

On a second execution of the routine, since F1 has been set at the first execution of the routine, the process goes to S112 where a fuel pressure $P_F$ detected by the fuel sensor 40 is compared with a preset feed pressure $P_L$ (for example 200 kPa). If $P_F$ is equal to or less than $P_L$, the process returns to the main routine via S111. On the other hand, if the fuel pressure $P_F$ reaches the feed pressure $P_L$ ($P_F>P_L$), the process goes from S112 to S113 where the starter motor prohibition flag $F_{ST}$ is cleared to admit a current-on to the starter motor 59 and at S114 the feed pressure flag F2 is set, thus the process returns to the main routine through S111. As mentioned above, since the starter motor prohibition flag $F_{ST}$ is cleared, an engine is started and as a result the high pressure fuel pump is operated, whereby the fuel pressure $P_F$ in the high pressure fuel system 23b being pressurerized.

On the second execution of the routine, the feed pressure flag F2 has been set and therefore on the following execution of the routine, the process goes directly to S115 where the fuel pressure $P_F$ is compared with a predetermined normal pressure $P_H$ (for example $1\times104$ KPa). If $P_F$ is equal to or less than $P_H$, the process returns to the main routine via S111. On the other hand, if the fuel pressure $P_F$ reaches the normal pressure $P_H$ ($P_F>P_H$), the process goes to S116 where the normal control flag F3 is set and the routine terminates via S111. Since the normal control flag F3 has been set as described above, on a following execution of the routine the process goes to S117 via S101 to S103 and at S117 a target fuel pressure $P_{FS}$ is determined by looking up a target fuel pressure table as a parameter engine speed N. The above target fuel pressure table is obtained experimentally as an optimum fuel pressure with respect to an engine speed in consideration of engine characteristics and fuel pump noise. As shown in a table at S117, the fuel pressure is determined in low at a low speed and in high at a high speed. The table is stored in the ROM 48.

After that the process goes from S117 to S118 where a basic control value for the high pressure fuel regulator 33, namely a basic duty $D_B$ is determined from a basic control value table predetermined before or a formula as a parameter of the above target fuel pressure $P_{FS}$ and at S119 a difference $\Delta P$ between the target pressure $P_{FS}$ and the fuel pressure $P_F$ is calculated, thus the process goes to S120. At S120, a proportional feedback value P is obtained by multiplying a proportional constant $K_P$ in the proportional integral control by the above difference $\Delta P$. Further, at S121 a value obtained by multiplying an integral constant $K_I$ in the proportional integral control by the difference $\Delta P$ is added to a former integral feedback value $I_{OLD}$ read from the RAM 49 and a new integral feedback value I is calculated ($I=I_{OLD}+K_I\times\Delta P$).

Stepping to S122, the former integral feedback value $I_{OLD}$ stored in the RAM 49 is renewed by the above integral feedback value I and at the next S123 an ON DUTY (feedback value for the high pressure fuel regulator) is obtained by adding the above basic duty $D_B$ to the above proportional feedback value P and the integral feedback value I ($DUTY=D_B+P+I$). Further at S110 this ON DUTY is set and then the process returns to the main routine via S111 described above. As a result of this, the fuel pressure $P_F$ is feedback-controlled.

Next, a process after an ignition key off will be explained. When the ignition key switch 56 is turned from on to off, the ECU relay 54 is turned off. At this moment, an I/O port output $G_S$ to the self-shut relay 61 is kept at a set condition (S111), that is to say, the ECU power source is self-held with a self-shut relay 61 on condition. When the ignition key switch 56 is turned off, the process goes from S101 to S124 where it is judged whether or not an engine is stationary by referring to an engine speed N. If N is not equal to 0, it is judged to be an instance that the ignition key switch 56 is turned off and the process returns to the main routine. Then in a while after the ignition key switch is turned off, N becomes 0. At this time it is judged that an engine is stopped and the process goes to S125 where a coolant temperature $T_W$ (a temperature representing an engine temperature) is compared with a predetermined value $T_{WS}$ (a temperature representing a hot condition of engine). The temperature $T_{WS}$ is determined beforehand according to experiments.

If $T_W$ is greater than $T_{WS}$, it is judged that an engine is in a hot condition and the process steps to S126.

At S126, a count value C indicating an elapsed time after an engine stop is compared with a set value $C_S$ (for example, a value corresponding to several ten minutes). In case where a predetermined time has not passed since an engine stop, namely, C is equal to or less than $C_S$, then the process goes to S127 where the count value C is counted up by 1 ($C=C+1$). At the next S109, an ON DUTY for the high pressure fuel regulator 33 is set to FFH (100%) and next at S110 this value (FFH) is set as an I/O port output value for the high pressure fuel regulator 33, whereby the high pressure fuel regulator 33 being fully closed so as to hold the fuel pressure $P_F$ in the high pressure fuel system in a high condition. Then the process returns to the main routine via S111. As a result of this, if an engine restart occurs within a specified time after an engine stop, a feedback control for fuel pressure is restarted immediately by the processes S101 to S103 and by S117.

On the other hand, under the hot condition of engine ($T_W>T_{WS}$), when a time C after an engine stop passes a predetermined time $C_S$ ($C>C_S$), the process goes to S128 where an I/O port output value $G_S$ for the self-shut relay 61 is set to 0 and thus the self-shut relay 61 is turned off, whereby the ECU power source is broken. Also in case where the coolant temperature $T_W$ becomes below a specified temperature $T_{WS}$ by the time when C reaches $C_S$, the process goes to S128 where the ECU power source is broken. Once the ECU power source is broken, each output value from the I/O port becomes 0, concurrently the high pressure fuel regulator 33 is fully opened and the fuel pressure in the high pressure fuel system 23b is released.

Thus, under a hot condition of engine after an engine stop, until a predetermined time elapses after an engine stop, the high pressure fuel regulator 33 is fully closed, whereby the fuel pressure in the high pressure fuel system is held in a high condition, so that vapor generation in the fuel system can be prevented. As a result of this, a good restartability of engine under a hot condition can be obtained. Furthermore, in case where engine temperature is low at an engine stop or where engine temperature becomes below a predetermined temperature within a predetermined time after an engine stop, no vapor is generated and therefore there is no need for holding a high pressure in the fuel system. In case where an engine is still in a hot condition even after a predetermined time elapses, the ECU power source is broken from an aspect of a battery power loss and to prevent malfunctions in the fuel system such as fuel leakage from a fuel injector.

Figure 1:
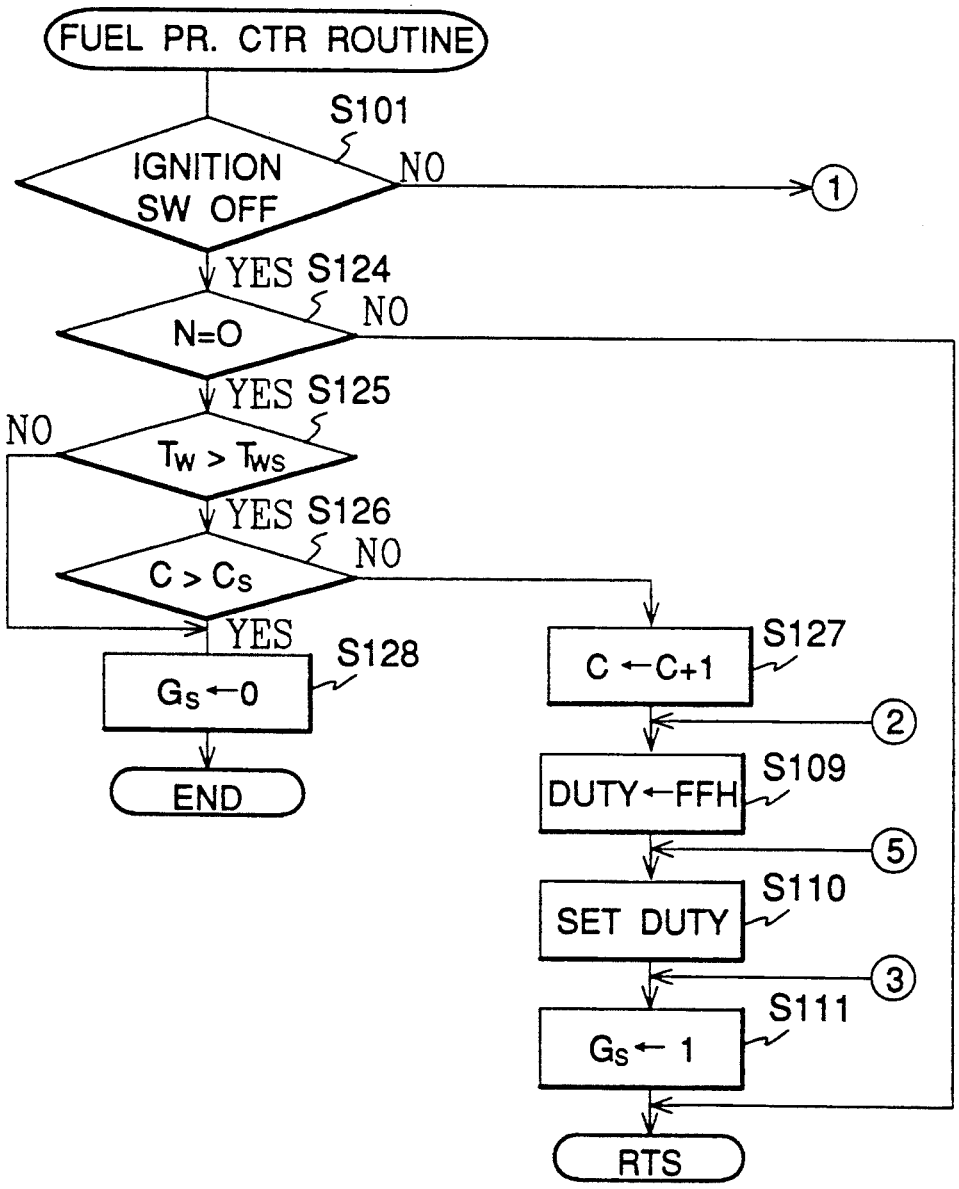
FIG. 1 to FIG. 8 indicate a first embodiment of the present invention and FIG. 9 to FIG. 11 illustrate a second embodiment thereof.
Figure 2:
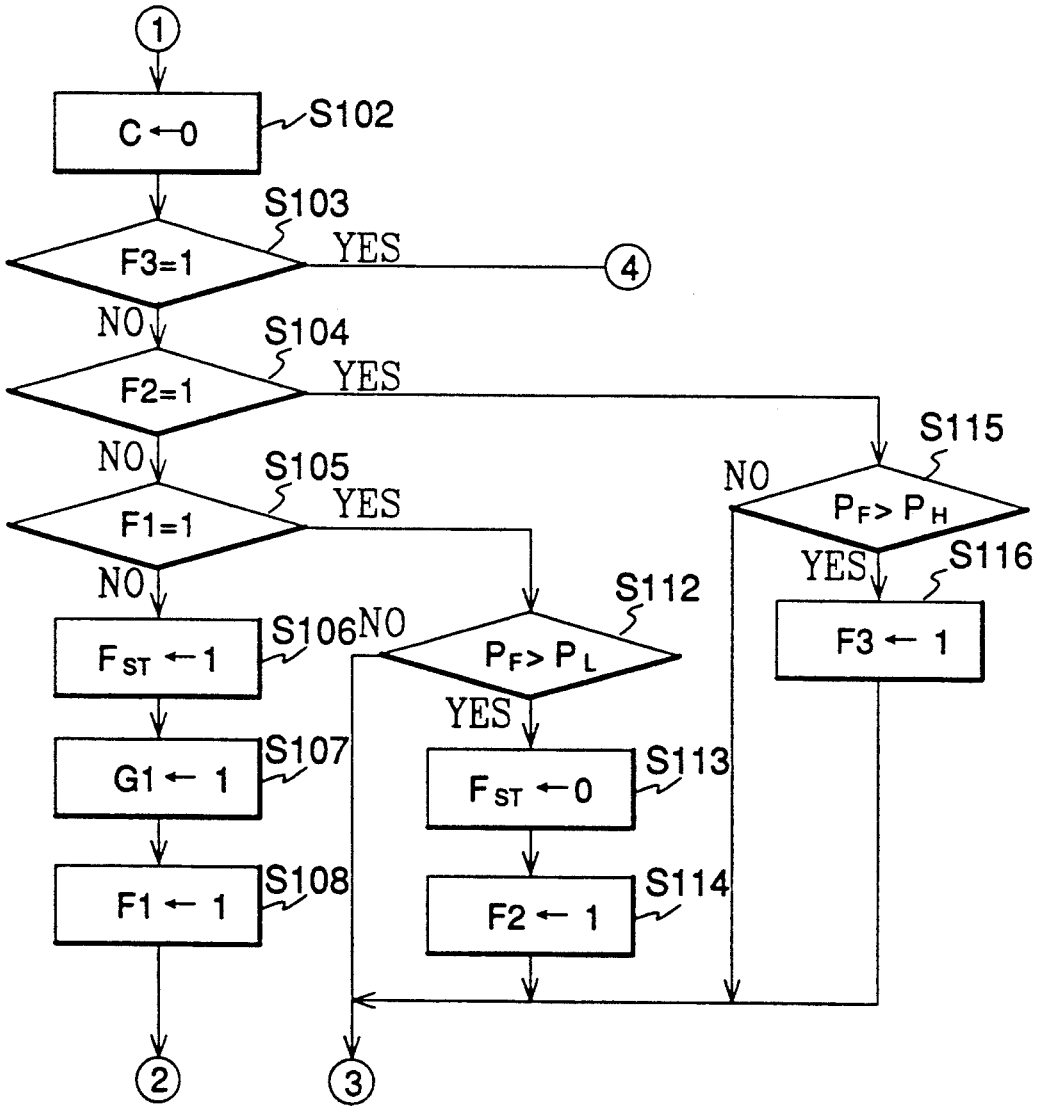
Figure 3:
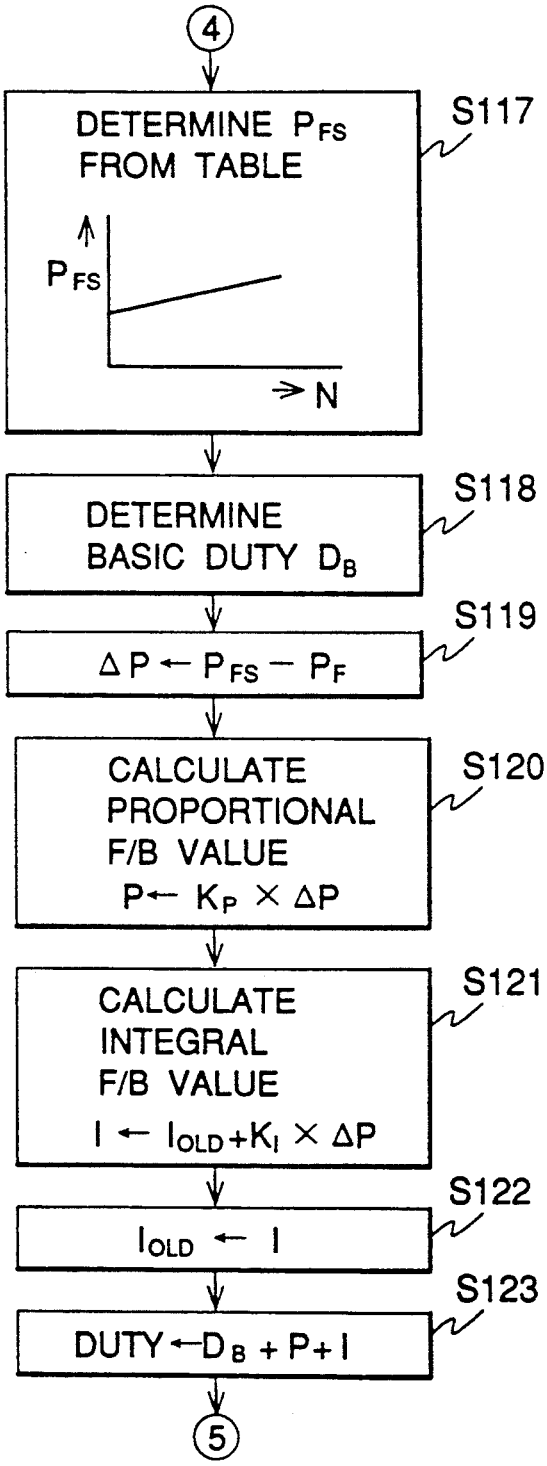
Figure 4:
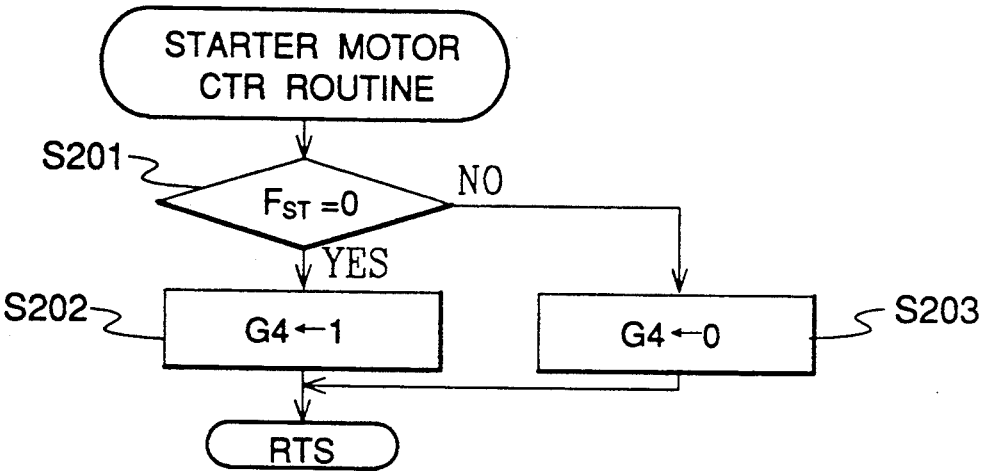

Referred now to a flowchart in FIG. 4, this flowchart illustrates a starter motor control routine which is carried out at a specified interval when the starter switch 57 is an "ON" condition. First at S201, a starter motor prohibition flag $F_{ST}$ is looked up to judge whether or not current to the starter motor 59 is permitted. If $F_{ST}=0$, namely, in case where current to the starter motor 59 is permitted, the process goes to S202 where an I/O port output value $G_4$ for the starter motor relay 58 is set to 1 so as to switch the starter motor relay 58 on and the process returns to the main routine. As a result of this, the starter motor 59 is turned on and a cranking is started.

On the other hand, if $F_{ST}=1$ at S201, namely, in case where current to the starter motor 59 is prohibited, the process goes to S203 where an I/O port output value $G_4$ for the starter motor relay 58 is set to 0 so as to switch the starter motor relay 58 off and the process returns to the main routine. As a result of this, the starter motor 59 is turned off even with the starter switch turned on until the fuel pressure $P_F$ reaches a feed pressure $P_L$ and an engine start is prohibited, whereby sticking or scuffing in the high pressure fuel pump 29 being prevented.

Figure 5:
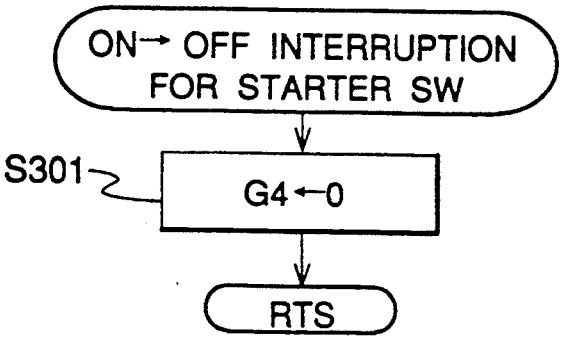

Referring now to a flowchart in FIG. 5, this flowchart shows a starter switch ON/OFF interruption routine to start an interruption when the starter switch 57 turned from on to off. At S301 an I/O port output value $G_4$ for the starter motor relay 58 is set to 0 so as to switch the starter motor relay 58 off and the process returns to the main routine.

Figure 6:
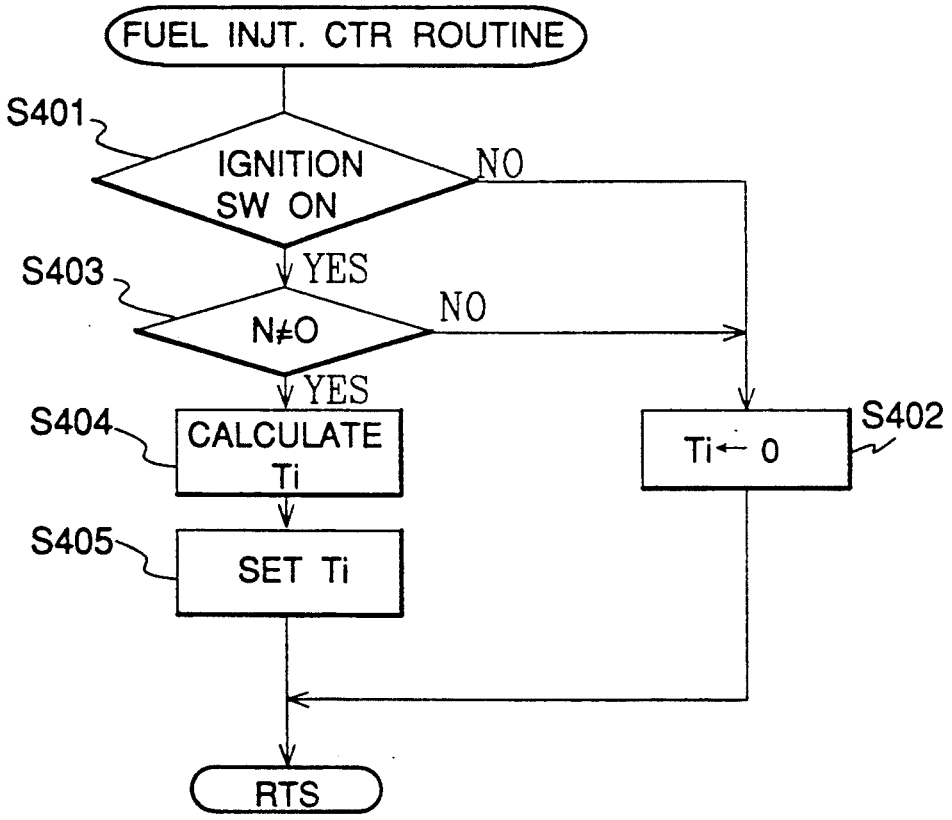

Referring to a flowchart in FIG. 6, this flowchart is a fuel injection control routine which is carried out at a specified interval while the power is applied to the ECU 46 after a system initialization. First at S401, it is judged whether the ignition switch 56 is turned on or off. If the ignition switch 56 is judged to be "off", the process goes to S402 where a fuel injection pulse width $T_i$ is rendered 0 to cut a fuel injection and the process returns to the main routine. If the ignition switch 56 is judged to be "on", the process goes to S403 where it is judged whether an engine speed N is 0 or not, that is to say, an engine rotates or not. If $N=0$, namely, an engine is stationary, the process goes to S402 where similarly a fuel injection pulse width $T_i$ is rendered 0 and the process returns to the main routine. If $N \neq 0$, the process goes from S403 to S404 where an optimum fuel injection pulse width $T_i$ is calculated by calling a fuel injection pulse width calculation routine (in that routine induction air amount Q, target air fuel ratio, air fuel ratio feedback correction coefficient and other coefficients are employed) and at S404 the above fuel injection pulse width $T_i$ is set, thus the process returns to the main routine. As a result of this, a drive signal corresponding to the above fuel injection pulse width is transmitted to the fuel injector 8 and fuel is injected therefrom.

Figure 9:
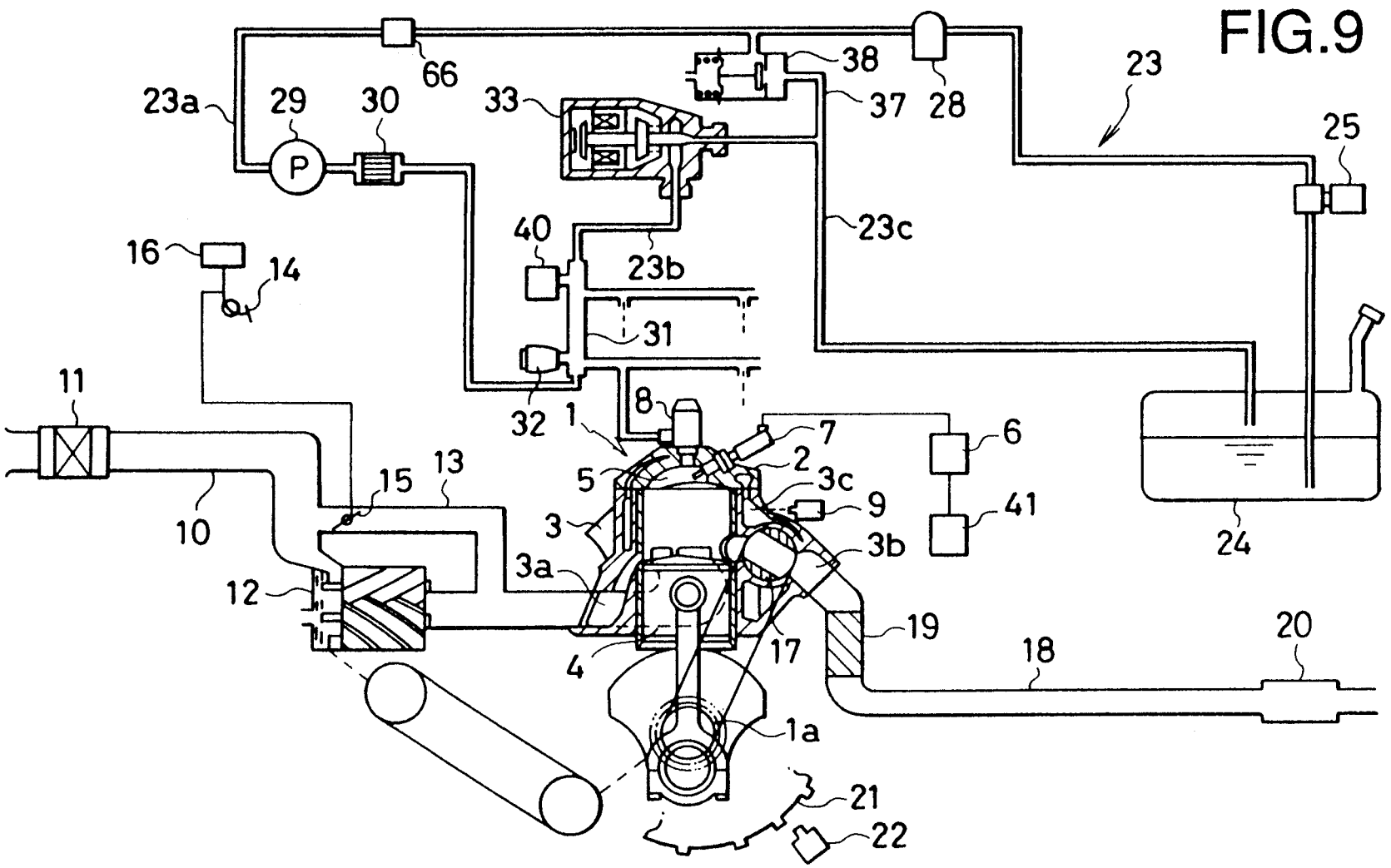
Figure 10:
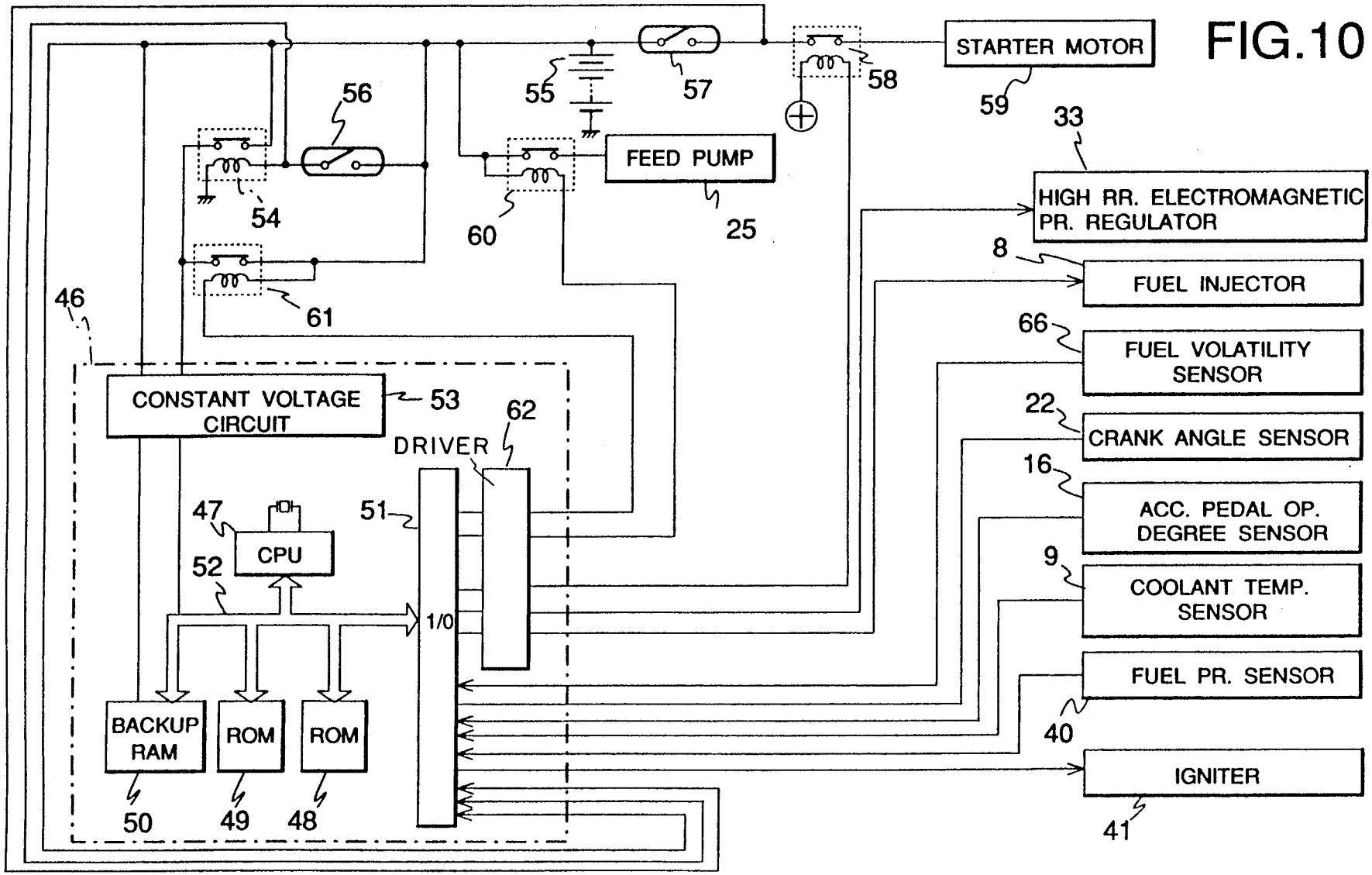
Figure 11:
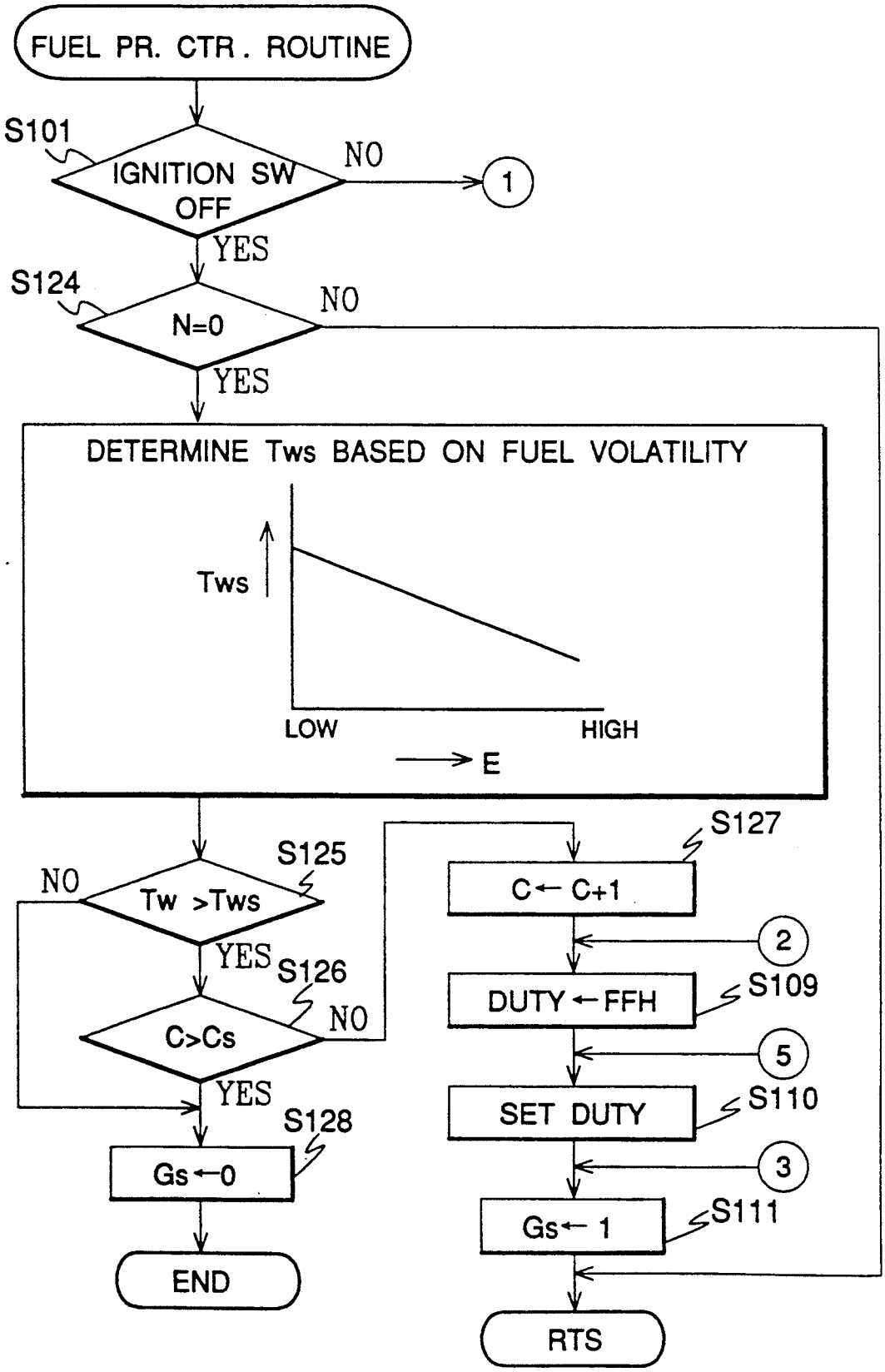

Next, according to FIG. 9 to FIG. 11 the second embodiment will be explained. FIG. 9 is a schematic view of the engine control system, FIG. 10 is a diagrammatic view of the control system, and FIG. 11 is a flowchart illustrating a fuel pressure control routine corresponding to FIG. 1. In this second embodiment, a predetermined temperature $T_{WS}$ for judging a hot condition of engine varies in accordance with fuel properties, especially fuel volatility.

Referring to FIG. 9, a fuel volatility sensor 66 is disposed between a fuel filter 28 and a high pressure fuel pump 29 to detect a specific gravity of the fuel. As shown in FIG. 10, the fuel volatility sensor 66 is connected with an input port of the I/O interface 51 in the ECU 46. The fuel volatility sensor 66 is composed of, for example, a pare of electrodes to detect a current change according to a change of electric conductivity. In place of the above electrode, a density meter may be used to detect a fuel density as a value representing fuel volatility. Further, the above fuel volatility sensor 66 may be placed at any other portion in the fuel system 23, not limiting to the position shown in this embodiment.

Referring now to the fuel pressure control routine in FIG. 11, if it is judged that an engine is stationary at S124, the process goes to S501 where a value $T_{WS}$ for judging a hot condition of engine is determined by referring to a table parameterizing a fuel volatility E which is detected by the fuel volatility sensor 66. An optimum value $T_{WS}$ corresponding to a given fuel volatility E is obtained beforehand by experiments or by other methods and the relationship between the optimum value $T_{WS}$ and the fuel volatility E is stored in this table. The higher the fuel volatility E is, the lower the predetermined value $T_{WS}$ is established, that is to say, vapor generates more easily at a lower temperature. Further, at S124 the coolant temperature $T_W$ is compared with the above predetermined value $T_{WS}$ to judge whether or not an engine is in a hot condition similarly to the first embodiment. Other processes than this are the same as flowcharts in FIG. 1 to FIG. 3, so description is omitted hereinafter.

In this second embodiment, since the predetermined value $T_{WS}$ is determined in accordance with the fuel volatility E, a high pressure condition of the fuel system is not needed to be held longer than necessity, therefore, the durability and reliability of the fuel system is improved that much.

The present invention is not limited to the aforementioned embodiments but other constructions such as a linear-solenoid type high pressure regulator, instead of an electromagnetic type high pressure regulator, may be considered for the high pressure regulator 33.

In summary, the present invention provides a fuel system characterized in that:

holding a high pressure condition in the high pressure fuel system for a specified time after an engine stop, whereby an engine can be restarted smoothly without any occurrence of vapor lock in the fuel system and prohibiting to switch a starter motor on while the fuel pressure reaches a specified feed pressure so as to prevent a fuel pump from being subjected to sticking or scuffing.

While the presently preferred embodiment of the present invention has been shown and described, it is to be understood that this disclosure is for the purpose of illustration and that various changes and modifications may be made without departing from the scope of the invention as set forth in the appended claims.

I claim:

1. A method for controlling the fuel pressure of a high pressure type direct fuel injection engine having, a fuel injector for injecting a high pressure fuel into a cylinder of said engine, a fuel tank for storing a fuel, a feed pump for pumping up said fuel from said fuel tank and for feeding said fuel to a fuel system, a low pressure fuel regulator for regulating a low fuel pressure in said fuel system, a high pressure fuel pump for producing a high pressure fuel in said fuel system and for supplying said high pressure fuel to said fuel injector, an accumulator for suppressing a fuel pulsation in said fuel system, a high pressure fuel regulator for regulating a high fuel pressure in said fuel system, a fuel pressure sensor for detecting a fuel pressure in said fuel system, an engine temperature sensor for detecting an engine temperature of said engine, and an electronic control unit for controlling said engine and said fuel system, the method comprising the steps of:

detecting said engine temperature by said engine temperature sensor;

detecting said fuel pressure by said fuel pressure sensor;

determining a first specified engine temperature for defining an engine hot condition under which a vapor lock occurs in said fuel system;

judging said engine hot condition from comparing said detected engine temperature with said first specified engine temperature;

determining a first specified fuel pressure at which said fuel pressure in said fuel system is held so as to prevent a generation of said vapor lock;

holding said fuel pressure at said first specified fuel pressure based on said detected fuel pressure for a predetermined time after an engine stop under said hot condition by closing said high pressure fuel regulator so as to prevent said vapor lock in said fuel system;

releasing said fuel pressure held at said first specified fuel pressure after said predetermined time elapses by opening said high pressure fuel regulator so as to avoid an exposure of said fuel system to a high pressure for a long time;

holding said fuel pressure at said first specified fuel pressure until said detected engine temperature goes down below said first specified engine temperature after an engine stop under said hot condition; and releasing said fuel pressure after said detected engine temperature is below said first specified engine temperature by opening said high pressure fuel regulator.

2. A method for controlling a starting system of a high pressure type direct fuel injection engine, the system having, a fuel injector for injecting a high pressure fuel into a cylinder of said engine, a starter motor for cranking said engine to start said engine, a starter motor relay for switching current to said starter motor on or off, an ignition key switch for switching an ignition system on or off and for switching current to said starter motor on or off, a starter switch for switching said starter motor relay on or off, a feed pump for feeding fuel to the fuel system, a high pressure fuel pump driven by said engine directly for supplying a high pressure fuel to said fuel injector, a feed pump relay for switching current to said feed pump on or off, and a fuel pressure sensor for detecting a fuel pressure in the fuel system, the system comprising the steps of:

detecting said fuel pressure by said fuel pressure sensor;

determining a second fuel pressure above which a good lubrication can be expected in said high pressure fuel pump of said engine;

prohibiting said starter motor from being switched on, when said ignition key switch is turned on and when said feed pump is operated to generate said fuel pressure, until said detected fuel pressure reaches said second fuel pressure so as not to operate said high pressure fuel pump; and permitting said starter motor to be switched on after said fuel pressure reaches said second fuel pressure so as to operate said high pressure fuel pump.

3. The method according to claim 1, wherein said engine temperature sensor is a coolant temperature sensor and said engine temperature is a coolant temperature.

4. The method according to claim 1, wherein said engine temperature sensor is an engine oil temperature sensor and said engine temperature is an engine oil temperature.

5. The method according to claim 1, wherein said engine temperature sensor is an engine room temperature sensor and said engine temperature is an engine room temperature.

6. A method for controlling the fuel pressure of a high pressure type direct fuel injection engine having, a fuel injector for injecting a high pressure fuel into a cylinder of said engine, a fuel tank for storing a fuel, a feed pump for pumping up said fuel from said fuel tank and for feeding said fuel to a fuel system, a low pressure fuel regulator for regulating a low fuel pressure in said fuel system, a high pressure fuel pump for producing a high pressure fuel in said fuel system and for supplying said high pressure fuel to said fuel injector, an accumulator for suppressing a fuel pulsation in said fuel system, a high pressure fuel regulator for regulating a high fuel pressure in said fuel system, a fuel pressure sensor for detecting a fuel pressure in said fuel system, an engine temperature sensor for detecting an engine temperature of said engine, a fuel volatility sensor for detecting a fuel volatility of said fuel, and an electronic control unit (ECU) for controlling said engine and said fuel system, the method comprising the steps of:

detecting said engine temperature by said engine temperature sensor;

detecting said fuel pressure by said fuel pressure sensor;

detecting said fuel volatility by said fuel volatility sensor;

storing a table showing the relationship between said fuel volatility and a second specified engine temperature for defining an engine hot condition under which a vapor lock occurs in said fuel system in said ECU;

determining said second specified engine temperature corresponding to said detected fuel volatility by referring to said table;

judging said engine hot condition from comparing said detected engine temperature with said second specified engine temperature;

determining a first specified fuel pressure at which said fuel pressure in said fuel system is held so as to prevent a generation of said vapor lock;

holding said fuel pressure at said first specified fuel pressure based on said detected fuel pressure for a predetermined time after an engine stop under said hot condition by closing said high pressure fuel regulator so as to prevent said vapor lock in said fuel system;

releasing said fuel pressure held at said first specified fuel pressure after said predetermined time elapses by opening said high pressure fuel regulator so as to avoid an exposure of said fuel system to a high pressure for a long time;

holding said fuel pressure at said first specified fuel pressure until said detected engine temperature goes down below said second specified engine temperature after an engine stop under said hot condition; and releasing said fuel pressure after said detected engine temperature is below said second specified engine temperature by opening said high pressure fuel regulator.

* * * * *